United States Patent [19]

Urban

[11] Patent Number: 4,920,250

[45] Date of Patent: Apr. 24, 1990

[54] FUSING APPARATUS WITH SELF-LEARNING HEATER

[75] Inventor: Carl T. Urban, Hilton, N.Y.

[73] Assignee: Eastman Kodak Company, Rochester, N.Y.

[21] Appl. No.: 291,837

[22] Filed: Dec. 29, 1988

[51] Int. Cl.[5] ..... H05B 1/00; G03G 15/00

[52] U.S. Cl. ..... 219/216; 34/48; 219/510; 355/285

[58] Field of Search ..... 432/60; 34/48; 219/216, 219/510; 355/285

[56] References Cited

U.S. PATENT DOCUMENTS

| | | | |
|---|---|---|---|
| 3,945,726 | 3/1976 | Ito et al. | 355/3 R |
| 4,009,953 | 3/1977 | Ravizza et al. | 355/3 R |
| 4,079,227 | 3/1978 | Takiguchi | 219/216 |
| 4,367,037 | 1/1983 | Nishikawa | 219/216 X |
| 4,556,779 | 12/1985 | Hashimoto et al. | 355/285 X |
| 4,778,980 | 10/1988 | Rathbun | 219/216 X |

*Primary Examiner*—William E. Wayner

*Attorney, Agent, or Firm*—Tallam I. Nguti

[57] ABSTRACT

An apparatus for fusing toner images to suitable substrates or copy sheets of paper includes a self-learning heater that substantially prevents "droop" or drops from a desired setpoint in the fusing temperature of the apparatus. The heater itself has a variable temperature control setpoint, and is connected to means for monitoring temperature variations due to heat lost by the apparatus to the substrates or copy sheets, as well as, to means for varying the temperature control setpoint of the heater in direct response to such monitored temperature variations. The heater as such, is capable of substantially preventing significant variations in the fusing temperature of the apparatus by effectively replacing such heat loss by the fusing apparatus.

10 Claims, 4 Drawing Sheets

WARM UP

WARM UP

IDLE

FUSING APPARATUS WITH SELF-LEARNING HEATER

BACKGROUND OF THE INVENTION

This invention relates to apparatus in electrostatographic copiers and printers for fusing tone images to suitable substrates or copy sheets of paper. More particularly, it relates to such a fusing apparatus having a self-learning heater that replaces heat lost by the apparatus to the substrates or copy sheets by varying its temperature control setpoint in direct response to temperature variations due to such heat loss, and thereby substantially preventing "droop" or drops from a desired setpoint in the fusing temperature of the apparatus.

In electrostatographic copiers and printers, it is well known, for example, to use a heat and pressure fusing apparatus for fusing toner images carried on suitable substrates or copy sheets of paper. Examples of such fusing apparatus are disclosed in U.S. Pat. No. 3,945,726, issued Mar. 23, 1976 to Ito et al; U.S. Pat. No. 4,079,227, issued Mar. 14, 1984 to Takiguchi, U.S. Pat. No. 4,487,158, issued Dec. 11, 1984 to Kayson; and U.S. Pat. No. 4,593,992, issued June 10, 1986 to Yoshinaga et al. Typically, such an apparatus includes a pressure roller, a fuser roller that can be made of a metallic core coated with an elastomer, and a heater whose temperature is controlled at a fixed setpoint. The heater is used for warming up and then maintaining the temperature, for example, of the fuser roller at a desired fusing setpoint. However, because the fuser roller ordinarily loses heat to the substrates or copy sheets being run, the actual temperature of the fuser roller, during fusing, usually will vary from such a fusing temperature setpoint.

Conventionally, in an effort to maintain the temperature of the fuser roller at the fusing setpoint, the heater (with its fixed control temperature setpoint) will be turned on or off in response to sensed deviations in the temperature of the fuser roller from such a fusing setpoint. Unfortunately however, because of the thermal inertia, for example, of the metallic cores of the rollers, as well as, the poor conductivity of the elastomeric coating of the fuser roller, the thermal response of the fuser roller to the heater being turned on or off, is usually delayed, and slow. The net result, in the case of a sensed dropping in the temperature of the fuser roller, can be a continued dropping (for a while), even after the heater had already been turned on in response. This characteristically, is what is termed "droop".

In high speed equipment, such continued dropping in the temperature of the fuser roller can result in incomplete fusing, and hence in poor copy quality. In addition to the droop problem, conventional heaters often are not heat efficient since they are themselves controlled at a fixed temperature setpoint, and will (at a given temperature and for a given time interval) ordinarily transfer substantially the same amount of heat to the fuser roller, regardless of any variations in the heat actually being lost by the fuser roller.

SUMMARY OF THE INVENTION

It is an object of the present invention to provide a fusing apparatus that substantially prevents "droop" or drops from a preset and desirable setpoint in its fusing temperature.

It is another object of the present invention to provide a fusing apparatus that has a fast warmup, as well as, a fast and effective thermal response in replacing heat lost to substrates or copy sheets during fusing.

It is a further object of the present invention to provide a fusing apparatus that is relatively very heat efficient.

In accordance with the present invention, a fusing apparatus includes a fuser roller that is heated externally by a self-learning heater. The heater, which can be controlled at a variable temperature setpoint, includes a heat element for directly raising or lowering its temperature, and is connected to a logic and control unit for monitoring temperature variations due to heat lost by the fuser roller to substrates or copy sheets being run by the apparatus. The temperature control setpoint for the heater can then be reset up or down in direct response to such monitored temperature variations. In this manner, the heater is capable of effectively replacing the heat lost by the fuser roller, and thereby capable of preventing significant variations in the temperature of the fuser roller from the fusing setpoint. The fusing apparatus of the present invention also includes a radiant heat reflector for conserving heat lost by the fusing apparatus.

BRIEF DESCRIPTION OF THE DRAWINGS

In the detailed description of the preferred embodiment of the invention presented below, reference is made to the accompanying drawings in which.

DETAILED DESCRIPTION OF THE PREFERRED EMBODIMENT

Figure 1:
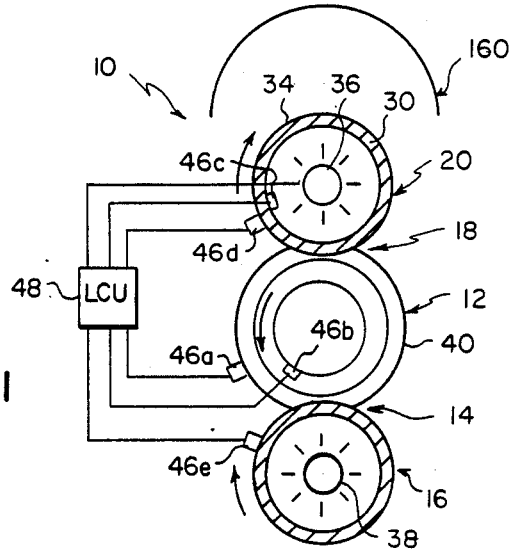
FIG. 1 is a cross-sectional elevational view of the fusing apparatus of the present invention during a warmup cycle.
Figure 2:
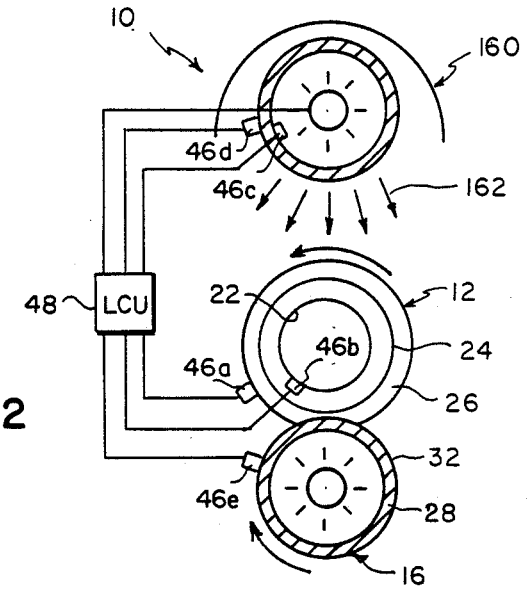
FIG. 2 is a similar view of the present invention during an idle cycle.
Figure 3:
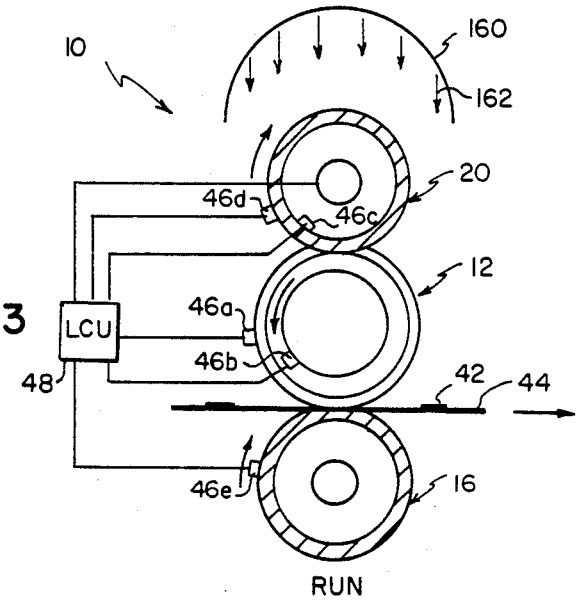
FIG. 3 is a similar view of the present invention during a run cycle.

Referring now to the drawings, a fusing apparatus of the present invention is generally designated 10, and is illustrated in FIGS. 1, 2 and 3. The apparatus 10, as shown in FIG. 1, includes a fuser roller 12 that forms a fusing nip 14 with a pressure roller 16. Apparatus 10 further includes a heater roller 20 that forms a heat transfer nip 18 with the fuser roller 12. As is well known, rollers 12, 16 and 20 are axially supported, and are drivable by suitable means (not shown) within the frame (not shown) of the apparatus 10.

The fuser roller 12 may consist of a hollow metallic core, for example, a steel core 22, that is coated with first and second elastomeric layers 24, 26. The second layer 26 which includes a suitable fusing surface 40, preferably should be made of an elastomer that is relatively compliant, and has good thermal conductivity. The pressure roller 16 on the other hand, consists of a hollow metallic core 28 with a surface 32 that may be hard anodized. Pressure roller 16 includes an internal heat source 38, and is useful additionally for externally heating the fuser roller 12.

The heater roller 20 is identical structurally to the pressure roller 16, and as such, consists of a hollow metallic core 30 that has a surface 34. In order to substantially prevent toner transfer and buildup from the fuser roller 12, the surface 34 may be coated with a thin layer, for example, of Teflon. [Teflon is a tradename of the Du Pont Co.] The heater roller 20 is heated internally by a heat source 36 which, for example, can be quartz lamp running the length of the core 30.

On the other hand, the fuser roller 12 is heated externally through contact with the heated surfaces 32, 34 of the pressure and heater rollers 16 and 20, respectively. As shown in FIGS. 1, 2 and 3, the pressure roller 16 is in constant engagement with the fuser roller 12 through a warmup cycle, an idle cycle and a run cycle of the apparatus 10. By design, the pressure roller 16 ordinarily is capable of warming up, and then maintaining the fusing temperature of the fuser roller 12 at a desired setpoint during the idle cycle. The heater roller 20, which can be moved by means (not shown) into and out of engagement with the fuser roller 12, is primarily used for replacing heat lost by the fuser roller to substrates or copy sheets during the run cycles.

As is well known in the art and shown in FIG. 3, when the fuser roller 12 has been heated through the warmup cycle (FIGS. 1 and 4) to the desired fusing temperature setpoint, for example, $T_{1C}$, (FIG. 4), the apparatus 10 can suitably be used through a run cycle (FIGS. 3 and 5) to fuse tone images 42 being carried on a substrate or copy sheet of paper 44 through the fusing nip 14. If however there are no substrates or copy sheets ready to run after the warmup cycle, as shown in FIG. 5, the apparatus 10 will instead go through an idle cycle during which the heater roller 20 is spaced from the fuser roller 12, as, shown in FIG. 2, and the temperature of the surface 40 of the fuser roller is maintained by the heated pressure roller 16 at such setpoint $T_{1C}$, in preparation for a run cycle.

Figure 4:
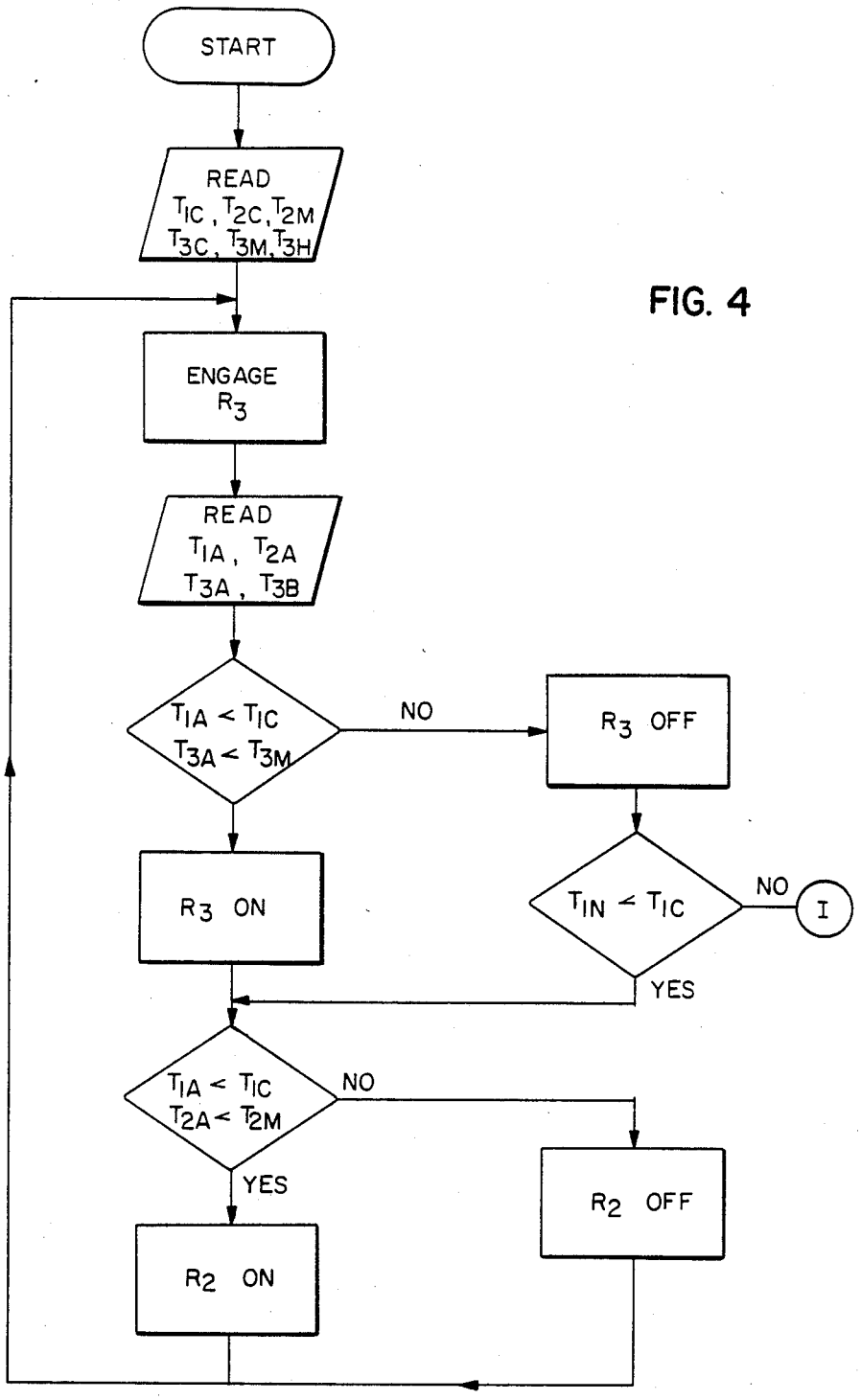
FIG. 4 is a flow diagram for controlling the apparatus of the present invention during a warmup cycle.
Figure 5:
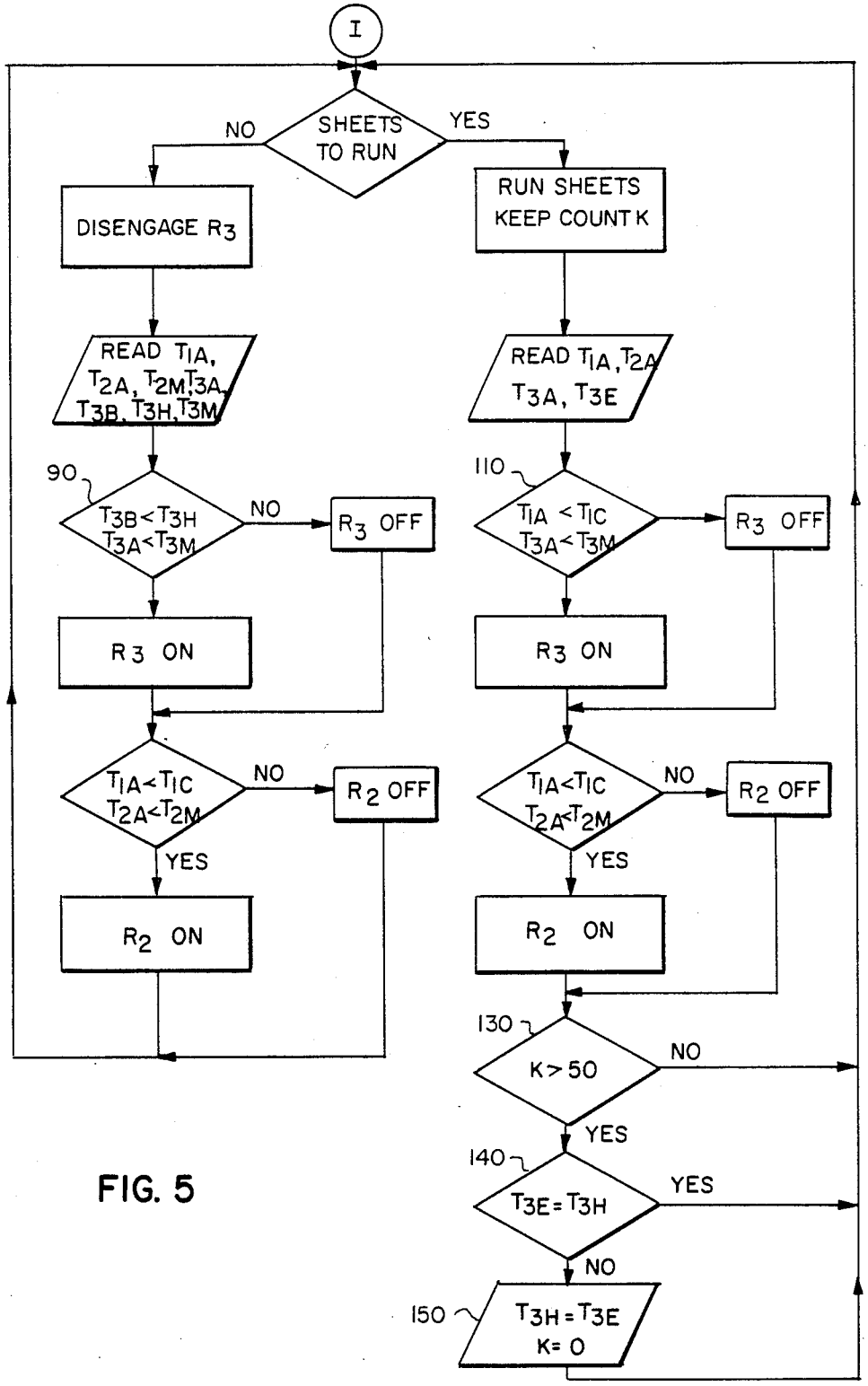
FIG. 5 are similar diagrams for the idle and run cycles of the present invention, including the self-learning step of the heater roller.

Referring particularly to FIGS. 4 and 5, $R_2$ in the pressure roller 16 with its heat source 38 being turned on or off, and similarly $R_3$ is the heater roller 20. $T_{1A}$, $T_{1C}$, $T_{1N}$ pertain to the fuser roller 12; $T_{2A}$, $T_{2C}$, $T_{2M}$ pertain to the pressure roller 16; and $T_{3A}$, $T_{3B}$, $T_{3C}$, $T_{3E}$, $T_{3M}$ pertain to the heater roller 20, and will all be defined in proper context below.

For controlling the actual temperature ($T_{1A}$) of the surface 40 of the fuser roller at the desired fusing temperature setpoint $T_{1C}$, the apparatus 10 includes a series of temperature sensors 46A, 46B associated with the fuser roller 12; 46C, 46D associated with the heater roller 20; and 46E associated with the pressure roller 16. On the fuser roller 12, the sensor 46A is positioned for sensing the actual temperature $T_{1A}$ of the surface 40, and the sensor 46B is positioned for sensing the actual temperature ($T_{1N}$) of the metallic core 22. Because fuser roller 12 is heated externally, heat transfer will be from the surface 40 inwards, through the layers 26 and 24, to the core 22. Best fusing results are obtainable if the temperatures $T_{1A}$ of the surface 40, and $T_{1N}$ of the core 22, are first raised to, and then controlled at a setpoint $T_{1C}$, for example, of 340°±10° F.

The sensor 46C is positioned for sensing the actual temperatures ($T_{3B}$) and ($T_{3E}$) within the hollow of the core 30 of the heater roller 20. $T_{3B}$ is the actual temperature within the core 30 during an idle cycle, and $T_{3E}$, which can be expected to be different from $T_{3B}$, is the actual temperature within the core 30 during or immediately after a run of a given number of substrates or copy sheets, for example, a run of 50 sheets. The sensor 46C has a temperature control setpoint designated as $T_{3H}$. On the other hand, the sensor 46D is positioned for sensing the actual temperature ($T_{3A}$) of the surface 34 of the heater roller 20. The sensor 46D has a temperature control setpoint ($T_{3C}$), with a maximum allowable temperature of $T_{3M}$. For a given heater roller 20, $T_{3H}$ should be the hollow temperature that results in a surface temperature of $T_{3C}$. Heat flow in the heater roller 20 is from the heat source 36 within to the outside surface 34, therefore, the actual temperatures $T_{3B}$, $T_{3E}$ of the hollow of the core 30, will ordinarily be slightly higher than the corresponding surface temperature $T_{3A}$ of the surface 34, especially since the surface 34 also loses heat when heating the surface 40.

The sensor 45E is positioned on the surface 32 of the pressure roller 16 for sensing the actual temperature ($T_{2A}$) of the surface 32. The sensor 46E has a temperature control setpoint ($T_{2C}$), with a maximum allowable temperature of ($T_{2M}$). In order to facilitate heat transfer to the surface 40 of the fuser roller 12, the setpoints $T_{2C}$ for the pressure roller 16, and $T_{3C}$ for the heater roller 20, should be significantly higher than the setpoint $T_{1C}$ for the fuser roller surface 40.

As illustrated in FIGS. 1, 2 and 3, all the sensors 46A–E, together with the heat sources 36, 38 of the heater and pressure rollers 20, 16 are operatively connected to a logic and control unit (LCU) 48 for proper monitoring and control at the various temperature setpoints. For example, the outputs of the sensors 46C and 46D are utilized by the logic and control unit (LCU) 48, during the idle cycle, for controlling the temperature $T_{3A}$ of the surface 34 at the setpoint $T_{3C}$, which by design (as described above), can also be achieved by controlling the corresponding temperature $T_{3B}$ within the core 30, at the setpoint $T_{3H}$.

When the apparatus 10 is first started up and is going through its warmup cycle, the heat sources 36, 38 are turned on, and both the pressure roller 16 and heater roller 20 are in contact with, and heating, the surface 40 of the fuser roller 12 (FIGS. 1 and 4). Such heating will continue as long as the actual surface temperature $T_{1A}$ of the surface 40 is less than the fusing temperature setpoint $T_{1C}$, and as long as the temperatures of the surfaces 32, 34 of the pressure and heater rollers 16, 20 are less than the respective allowed maximums $T_{2M}$ and $T_{3M}$. When the actual temperature $T_{1A}$ of the surface 40 is at the setpoint $T_{1C}$, and other conditions are also satisfied, the heat sources 36, 38 of the heater and pressure rollers $R_3$, $R_2$ respectively are turned off, and the apparatus 10 is ready for its run cycle during which toner images 42 can be acceptably fused to a substrate or copy sheet or paper 44 fed through the fusing nip 14.

It is known, of course, that each such copy sheet 44 removes heat from the surface 40 of the fuser roller 12, thereby causing the fuser roller to accordingly lose heat. Variations in the weight and temperature of the copy sheets of paper being used, as well as, variations in the density of toner being fused, directly affect the quantity of heat being lost by the surface 40 during any run cycle. The effect eventually is to cause the actual temperature $T_{1A}$ of the surface 40, to start to drop below the setpoint $T_{1C}$.

Conventionally, the response to such a dropping in the temperature $T_{1A}$ of the surface 40, would be merely to turn on a heat source, such as the source 38 of the pressure roller 16 (which as described above has a fixed control temperature setpoint), in an effort to begin reheating the surface 40 back up to the setpoint $T_{1C}$. However, such a conventional response usually is not effective because the thermal inertia, for example, of the aluminum cores 28, 30 of the pressure and heater rollers, and the relatively poor conductivity of the elastomeric layers 26, 24 of the fuser roller 12, will tend to delay, and slow down the thermal response of the fuser roller to such a heater being turned on. As a consequence, a continued dropping in the temperature $T_{1A}$ of the surface 40 of the fuser 12, can be expected for a period of time, even after such a heater has been turned on in response to the initial sensed dropping of the temperatures $T_{1A}$. This of course is the problem characteristically termed "droop."

Furthermore, because the heat lost by the fuser roller to the substrates or copy sheets can vary from run cycle to run cycle, the drop in the temperature $T_{1A}$, will likely also vary accordingly, thereby making the conventional method of responding to the drop or "droop" with a fixed temperature control setpoint heater, even less effective.

In the apparatus 10 of the present invention, as described above, the heated pressure roller 16 ordinarily is capable of warming up and then maintaining the temperature $T_{1A}$ of the surface of the fuser roller 12 at the fusing setpoint $T_{1C}$ during idle cycles. The heater roller 20 is used during the warmup cycle for heating the fuser roller only in order to shorten the warmup cycle by speeding up the response of the apparatus after start up. The primary function of the heater roller 20 however, is to replace heat lost by the surface 40 of the fuser roller 12 to the substrates or copy sheets of paper 44 during run cycles.

To be effective in replacing such heat lost by the fuser roller, the heater roller 20 of the present invention is made self-learning by connecting it to the logic and control unit (LCU) 48. The LCU, as illustrated in FIG. 5, monitors temperature variations due to heat lost by the fuser roller 12 to substrates or copy sheets, and then responsively adjusts the temperature control setpoints $T_{3C}$, $T_{3H}$ of the heater roller 20 (during the next idle cycle) up or down. Such responsive up and down adjustment can be accomplished by sensing and comparing the actual temperature $T_{3A}$ of the surface 34 of the heater roller 20 during an idle cycle with the same temperature during the ensuing run cycle.

However, because the surface 34 directly loses heat to the surface 40 of the fuser roller 12, it is preferable to instead sense and compare the actual corresponding temperatures $T_{3B}$ and $T_{3E}$ within the hollow of the core 30 of the heater roller 20. As set out in FIGS. 4 and 5, the temperature setpoint $T_{3H}$ of the hollow of the core 30, and hence its corresponding surface temperature setpoint $T_{3C}$, can then be adjusted accordingly up and down in direct response to the temperature variations due to the actual heat being lost by the surface 40.

Such adjustment assures that during the next idle cycle, the hollow of the core 30 of the heater roller 20, will be controlled at a higher or lower temperature setpoint $T_{3W}$ (corresponding to a higher or lower surface temperature setpoint $T_{3C}$) that is sufficiently and calculated high enough, so as to make the heater roller 20 capable of effectively replacing heat lost by the fuser roller 12 to substrates or copy sheets, right from the start of such a run cycle. When the heater roller is controlled at such an adjusted temperature setpoint, it effectively prevents significant deviations from the setpoint in the temperature of the fuser roller 12 due to heat lost to the substrates or copy sheets, and thereby substantially eliminates the problem of "droop".

As shown in FIGS. 4 and 5, the effectiveness of the heater roller 20 is further assured by the ability of the logic and control unit 48 to switch the control of the temperature of the heater roller 20 over from the output signals of the sensor 46D, to the output signals of the sensor 46A. As shown, after the apparatus 10 is fully warmed up, it will switch to an idle cycle (FIGS. 2 and 5), if there are no copy sheets ready to run. Alternatively, it will switch over to a run cycle (FIG. 5) when copy sheets are ready to run. During the idle cycle, the heater roller 20 is disengaged from the fuser roller 12, and the actual temperature $T_{3B}$, (box 90, FIG. 5) inside the hollow of the core 30 as sensed by the sensor 46C, will be controlled by the LCU 48 at the setpoint $T_{3H}$, which by design, corresponds to a surface temperature setpoint $T_{3C}$ of the roller 20. Thus, the setpoint $T_{3C}$ (corresponding to $T_{3H}$) as sensed by the sensor 46D, is utilized for controlling the on and off cycling of the heat source 36 of heater roller 20 during idle cycles.

However, during a run cycle, (FIGS. 3 and 5) the heater roller 20 will be brought back into heat transfer engagement with the fuser roller 12, and control of the on and off cycling of the heat source 36 of the heater roller 20 automatically switches over from the output signals of the sensor 46D, to those of the sensor 46A, (FIG. 3; box 110, FIG. 5). As shown in FIG. 5, the heat source 36 of the heater roller 20 when being controlled from the sensor 46A, will remain turned on without regard to the setpoints $T_{3C}$ and $T_{3H}$, provided $T_{1A}$ due to heat being lost to the substrates or copy sheets, is less than $T_{1C}$, and $T_{3A}$ is less than $T_{3M}$.

When controlled in this manner, and with the pressure roller 16 ordinarily able to maintain the temperature of the fuser roller 12 at its setpoint $T_{1C}$, the heater roller 20 will supply only as much heat as is necessary to replace heat being lost by the fuser roller 12 to substrates or copy sheets being run, and therefore only as much heat as is necessary to maintain $T_{1A}$ at $T_{1C}$. As such, in order to replace heat being lost by the fuser roller 12 during a run cycle, the heat source 36 may have to work less than, or harder than it did during the preceding idle cycle.

If it works harder, then the actual temperature $T_{3E}$ of the hollow of the core 30 during such a run cycle, will likely go higher than the previous idle cycle temperature setpoint $T_{3H}$, even if the surface temperature $T_{3A}$ of the surface 34 does not go up correspondingly due to the heat being transferred from the surface 34 to the surface 40. If the heat source 36 instead works less during a run cycle than it did during a preceding idle cycle, then the actual temperature $T_{3E}$ of the hollow of the core 30 during such a run cycle, will likely drop below the temperature setpoint $T_{3H}$ of the preceding idle cycle.

If the heat source 36, of course, neither works harder nor less during a run cycle than it did during a preceding idle cycle, then there will be no difference between the temperature $T_{3E}$ during the run, and the temperature $T_{3B}$, which during the preceding idle cycle was being controlled at the setpoint $T_{3H}$. It is expected, however, that variations in the heat lost by fuser roller 12 due to variations in the temperature and weight of copy sheets of paper being run, will be significant after a run count K, for example, of 50 sheets (box 130, FIG. 5). It is therefore expected that such variations will tend to cause an increase or a drop in the actual temperature $T_{3E}$ of the hollow of the core 30 during the run cycle.

Therefore, according to the self-learning feature of the heater roller 20, after a run count of 50, the actual temperature $T_{3E}$ of the hollow of the core 30, is compared to the temperature setpoint $T_{3H}$ of the preceding idle cycle (box 140, FIG. 5). As indicated in box 140 and 150, FIG. 5, where $T_{3E}$ is different from $T_{3H}$, the value of $T_{3H}$ is then reset equal to $T_{3E}$, a value which may be higher or lower than the original value of $T_{3H}$.

Such resetting as shown in FIG. 5, is carried out after each run of 50 sheets until the job being run is over, and the apparatus 10 then switches back into the next idle cycle (FIGS. 2 and 5). During such next idle cycle, the temperature $T_{3A}$ of the surface 34 of the heater roller 20, and hence the corresponding temperature $T_{3B}$ of its core 30, will then be controlled at the new value $T_{3C}$ which corresponds to the new rest value $T_{3H}$. The direct effect of resetting the idle cycle hollow temperature setpoint $T_{3H}$ to such a higher or lower temperature value $T_{3E}$ (which of course corresponds to a higher or lower surface temperature setpoint $T_{3C}$), is to provide, and to ensure a fast thermal response in the replacement of heat being lost by the fuser roller 12 to substrates or copy sheets run during the next run cycle. Controlling the temperature of the heater roller 20 in this manner during an idle cycle, ensures that the heater roller 20 is capable of effectively replacing heat lost by the fuser roller 12 during the next run cycle, without the fuser roller 12 experiencing the conventional delayed response or "droop" at the start of such a run cycle.

The advantages of the apparatus 10 of the present invention therefore include not only a fast warmup cycle due to the use of both the heater roller 20 and the heated pressure roller 16 during such warmup cycle, but also a fast thermal response (in the replacement of heat lost by the fuser roller to substrates or copy sheets during a run cycle) that is achieved by adjusting the temperature control setpoint of the heater roller 20 up or down in direct response to temperature variations due to such heat loss. Additionally, adjusting the temperature control setpoint of the heater roller 20 up or down in this manner, makes the apparatus 10 relatively more heat efficient than apparatus having fixed temperature control setpoint heaters.

Furthermore, the apparatus 10 includes a radiant heat reflector 160 that is positioned outside of, and adjacent the heater roller 20. The reflector 160 which includes a concave reflecting surface, additionally makes the apparatus 10 even more heat efficient by reflecting and concentrating heat rays, shown as 162, from the heater roller 20, back onto the fuser roller 12.

Although the invention has been described with particular reference to a preferred embodiment, it is understood that modifications and variations can be effected within the scope and spirit of the invention.

I claim:

1. In an electrostatographic copier or printer, an apparatus for fusing tone images to suitable substrates or copy sheets of paper by heat and pressure, the apparatus including:

(a) a pressure roller;

(b) a fuser roller forming a fusing nip with said pressure roller through which substrate or copy sheets carrying toner images for fusing can be run; and (c) a self-learning heater roller in heat transfer relationship with said fuser roller for effectively replacing heat lost by said fuser roller to such substrates or copy sheets, said heater roller including (i) logic and control means capable of monitoring temperature variations due to heat lost by said fuser roller to such substrates or copy sheets, (ii) a heat source for heating said heater roller to original temperature setpoint, and (iii) means for resetting such original temperature setpoint of said heater roller in direct response to such monitored temperature variations.

2. The invention as set forth in claim 1 wherein said pressure roller includes a heat source, and is capable of externally heating and maintaining the temperature of said fuser roller at a desired fusing setpoint.

3. The invention as set forth in claim 1 wherein the heat source for heating said heater roller can be turned on and off in accordance with a first set of output signals from a first sensor associated with said heater roller, and in accordance with a second set of output signals from a second sensor associated instead with said fuser roller.

4. The invention as set forth in claim 3 wherein the on and off control of said heat source for heating said heater roller in accordance with the set of signals from the second sensor is not restricted by the first sensor.

5. In an electrostatographic copier or printer an apparatus for fusing powder images to substrates or copy sheets, the apparatus comprising:

(a) a fuser roller operated at a desired fusing temperature setpoint for fusing such powder images to the substrates or copy sheets;

(b) a plurality of heater rollers for externally heating said fuser roller through a warmup cycle during which said fuser roller is heated to such a desired fusing temperature setpoint, a run cycle during which powder images on a substrate can be fused thereto, and an idle cycle between the warmup and run cycles or between successive run cycles during which the temperature of said fuser roller is maintained at the desired fusing temperature setpoint;

(c) a first roller of said heater rollers having a fixed temperature control setpoint, and being located in a fixed position relative to said fuser roller for providing heat to said fuser roller during all cycles of operation; and (d) a second roller of said heater rollers suitable for replacing heat lost by said fuser roller to the substrates or copy sheets, said second roller having a variable temperature control setpoint and including means for monitoring temperature variations due to heat lost by said fuser roller to the substrates or copy sheets, as well as, means for accordingly resetting said temperature control setpoint of said second roller in direct response to such monitored temperature variations.

6. The invention as set forth in claim 5 wherein said second roller is movable away from said fuser roller during the idle cycles, and toward said fuser roller (i) during the warmup cycle for increasing the heat being transferred to said fuser roller thereby speeding up the warmup response of the fuser roller, and (ii) during the run cycles for replacing heat lost by the fuser roller to the substrates or copy sheets.

7. The invention as set forth in claim 5 further including a radiant heat reflector positioned outside of, and adjacent said second roller for making the apparatus heat efficient by reflecting and concentrating heat from at least one of said heater rollers onto the fuser roller during all cycles of operation.

8. The invention as set forth in claim 5 wherein said first roller of said heating rollers is in constant engagement with said fuser roller, and said second roller selectively engages and disengages said fuser roller.

9. The invention as set forth in claim 5 wherein said first roller of said heating rollers is also a pressure roller forming a fusing nip with said fuser roller.

10. An electrostatographic fusing apparatus comprising:

(a) a fuser roller having an unheated core, and an externally heated surface effective at a desired fusing temperature setpoint for fusing powder images to substrates or copy sheets;

(b) a first heater roller for externally heating said fuser roller through a warmup cycle during which the surface of the fuser roller is heated to the desired fusing temperature setpoint, a run cycle when powder images on a substrate can be fused thereto, and an idle cycle between the warmup and run cycles or between successive run cycles during which said first roller maintains the temperature of the surface of the fuser roller at the desired fusing temperature setpoint in preparation for a run cycle; and (c) a second heater roller for replacing heat lost by said fuser roller to the substrates or copy sheets, said second roller having a variable idle cycle temperature setpoint and means associated therewith for monitoring variations in temperature due to heat lost by said fuser roller to the substrates or copy sheets during run cycles, and for then varying said idle cycle temperature setpoint of said second roller in direct response to such monitored temperature variations, so as to make said second roller effectively capable of replacing the heat lost by the said fuser roller, and thereby capable of substantially preventing drops or droop from the desired fusing setpoint of the temperature of the surface of said fuser roller.

* * * * *

UNITED STATES PATENT AND TRADEMARK OFFICE

CERTIFICATE OF CORRECTION

PATENT NO. : 4,920,250

DATED : April 24, 1990

INVENTOR(S) : Carl T. Urban

It is certified that error appears in the above-identified patent and that said Letters Patent is hereby corrected as shown below:

Col. 7, Claim 1, line 57 --after "fusing" "tone" should be --toner--.

Col. 7, Claim 1, line 62 --in paragraph (b), after "which" "substrate" should be --substrates--.

Signed and Sealed this

Nineteenth Day of November, 1991

*Attest:*

HARRY F. MANBECK, JR.

*Attesting Officer*

*Commissioner of Patents and Trademarks*